United States Patent [19]

Horsewell et al.

[11] 4,088,142

[45] May 9, 1978

[54] CIGARETTES

[75] Inventors: Henry George Horsewell, Totton; Robin Arthur Crellin, Romsey, both of England

[73] Assignee: British American Tobacco Co., Ltd., London, England

[21] Appl. No.: 728,408

[22] Filed: Sep. 30, 1976

[30] Foreign Application Priority Data

Oct. 28, 1975 United Kingdom ..... 44432/75

[51] Int. Cl.[2] ..... A24D 1/02; A24B 15/00

[52] U.S. Cl. ..... 131/9; 131/15 B

[58] Field of Search ..... 131/15 R, 15 B, 15 C, 131/8 R, 9; 162/139

[56] References Cited

U.S. PATENT DOCUMENTS

| | | | |
|---|---|---|---|
| 2,269,995 | 1/1942 | Trane | 131/15 B X |
| 2,304,009 | 12/1942 | Muth | 131/15 B |
| 3,046,994 | 7/1962 | Schur | 131/15 B X |
| 3,475,591 | 10/1969 | Fujii | 131/15 B X |

OTHER PUBLICATIONS

Tobacco, Publication Date of 9/28/73; pp. 26 & 28 cited; "Low-tar-nicotine Content Design" by Samfield.

Tobacco, Publication date of 6/5/1970; pp. 17-20 cited; "Alteration of Cigarette Smoke Composition II. Influence of Cigarette Design" by Terrell et al.

Tobacco and Tobacco Smoke by Wynder et al.; Academic Press, N. Y. & London, 1967 p. 537 cited.

*Primary Examiner*—Robert W. Michell
*Assistant Examiner*—V. Millin
*Attorney, Agent, or Firm*—Kane, Dalsimer, Kane, Sullivan and Kurucz

[57] ABSTRACT

The invention is concerned with a wrapped cigarette and a method of producing the wrapper. A very highly porous wrapping paper, with air porosity within the range from 2,450 to 20,000cm$^3$min$^{-1}$10cm$^{-2}$10cmWG$^{-1}$is produced by perforation from a base paper having a tensile breaking strength of not less than 85 g per mm width of paper. The means number of perforations is suitably within the range from 10 to 150 per cm$^2$ of the paper and the mean diameter within the range from 30 to 200 microns. A cigarette wrapped in the highly porous paper may advantageously be provided with a tobacco-smoke filter having a filtration efficiency for nicotine within the range of 15 to 30%.

4 Claims, No Drawings

CIGARETTES

BACKGROUND OF THE INVENTION

1. Field of the Invention

This invention concerns improvements relating to cigarettes and like smoking articles wrapped in paper, hereinafter referred to as cigarettes.

2. Brief Description of the Prior Art

Cigarettes having ventilated areas distributed over the wrapper paper are known. The resultant mixing of air with the smoke not only gives a cooler and milder smoke, but also reduces the delivery of some of the constituents of the smoke.

The delivery of one smoke constituent, carbon monoxide, can be reduced, using a catalyst, by reaction with oxygen to form carbon dioxide. The use of catalysts, particularly in the form of fine particles, presents considerable problems. For example, the catalyst could transfer to the smoke, thereby introducing unwanted, substances, often heavy-metal compounds. Furthermore, catalysts can be deactivated by water adsorption or "poisoned" by smoke constituents.

It is possible to reduce carbon monoxide in cigarette smoke to some extent by using a very porous paper wrapper, but it has been found that the nicotine is also reduced to such a great extent that the cigarette is no longer satisfactory to the smoker. A highly porous paper has also been found to decrease the puff number of the cigarette, which is not desirable. Finally, papers of inherently very high porosity have low breaking strength in the longitudinal direction, which causes problems in cigarette manufacture.

The present invention seeks, in particular, to provide a cigarette capable of giving a smoke with a low ratio of carbon monoxide to nicotine, that is with a substantially normal, acceptable nicotine content, but very low carbon-monoxide content. It is also sought to provide, at the same time, a normal, or greater than normal, number of puffs.

SUMMARY OF THE INVENTION

According to the invention, a cigarette is wrapped in a material which consists of very highly porous paper, with an air porosity within the range from 2,450 to 20,000 $cm^3min^{-1}10cm^{-2}10cmWG^{-1}$ (WG = water gauge) produced from a base paper having a tensile breaking strength of not less than 85 g per mm width of paper by perforation of the paper. Preferably the breaking strength of the base paper is not less than 95 g per mm width of paper. Suitably the perforation is performed electrostatically, or by laser, which does not excessively affect the strength of the paper, but it may be performed mechanically. Over the aforesaid porosity range, the mean number of perforations may be within the range from 10 per $cm^2$ of the paper (for a porosity figure of 2,450) to 150 (for a porosity figure of 20,000) and the mean diameter thereof within the range from 30 to 200 microns, respectively, depending in part upon the method of perforation.

DETAILED DESCRIPTION OF THE INVENTION

A wrapper paper as described above is sufficiently strong for use with known cigarette-making machines. For comparison, a highly porous, non-perforated, paper with which a tobacco rod could be wrapped without breaking has a porosity of only about $1000cm^3min^{-1}10cm^{-2}10cmWG^{-1}$.

A cigarette wrapped with the aforesaid perforated paper gives a smoke having a low, generally very low, carbon monoxide content, a substantially normal, acceptable, nicotine delivery and an acceptable, normal or better than normal, puff number. The paper is preferably perforated so as to leave a small non-perforated margin at each edge. This assists in preventing the paper from breaking during preparation and cigarette manufacture.

A cigarette wrapped with the aforesaid material may be used with a filter of conventional tobacco-smoke filter material such, for example, as cellulose acetate. Preferably the filter is then made with a low filtration efficiency for nicotine, suitably of the order of 15 – 30%, in order to avoid reduction of the nicotine delivery to an unacceptably low level.

Also according to the invention, a method of producing a cigarette-wrapper comprises the step of perforating a base paper material having a tensile breaking strength of not less then 85 g per mm width of paper so as to impart to the paper a very high air porosity within the range from 2,450 to 20,000 $cm^3min^{-1}10cm^{-2}10cmWG^{-1}$.

The following examples illustrate ways of carrying out the invention and results thereby achieved.

The unit of porosity of cigarette paper is defined as the flow rate through the paper ($cm^3min^{-1}$) when air is forced through an area of $10cm^2$ under a pressure of 10cmWG. If the paper has unusually high porosity, however, the flow rate through that area is too high for convenient accurate measurement. Hence, for the following examples, the area of the paper was reduced to $2.5cm^2$, the pressure of 10cmWG being retained. For estimating the porosity in the defined units, the observed flow rate was multiplied by a factor of 4 to take account of the reduction in area.

EXAMPLE 1

A cigarette was made using a blend of flue-cured Virginia tobacco. The cigarette consisted of a tobacco rod 70 mm long with a circumference of 25.0 mm.

A cigarette wrapping paper was produced from a conventional cigarette paper having a tensile breaking strength of 110 g per mm paper width and a porosity of $80cm^3min^{-1}10cm^{-2}10cmWG^{-1}$, which paper was electrostatically perforated in per se known manner to give a porosity of $8500cm^3min^{-1}10cm^{-2}10cmWG^{-1}$. The mean number of holes per $cm^2$ paper was 80 and their mean diameter $110\mu$. The electrostatically perforated paper had a tensile strength of 95 g per mm paper width, which is not unacceptably lower than the original strength. The pressure drop of the aforesaid tobacco rod wrapped in this paper was 4.1 to 4.5cmWG at a flow rate of $1050cm^3min^{-1}$.

The cigarette thus produced, when smoked under standard conditions of 1 puff per minute of $35cm^3$ volume and 2 second duration, delivered 13.7 mg TPM (total particulate matter), 1.00 mg nicotine and 4.0 mg carbon monoxide. The ratio of carbon monoxide to nicotine was thus 4.0. A comparable, normally wrapped, cigarette using non-perforated paper delivered 43.0 mg TPM, 2.36 mg nicotine and 23.3 mg carbon monoxide, the ratio of CO to nicotine being 9.9. The use of the perforated paper thus achieved a substantial reduction in carbon monoxide. Additionally, under the aforesaid conditions, the cigarette with the perforated wrapper gave 13.5 puffs, whereas a cigarette wrapped in conventional, but non-perforated, paper gave 10.0 puffs.

EXAMPLE 2

A cigarette wrapping paper was produced from the same conventional cigarette-wrapping paper as in Example 1, but was electrostatically perforated to give a porosity of 2,500cm$^3$min$^{-1}$10cm$^{-2}$10cmWG$^{-1}$. The mean number of holes per cm$^2$ paper was 45 and their mean diameter 70$\mu$. The strength of the perforated paper was 95 g per mm width. The pressure drop of the tobacco rod, similar to that of Example 1, wrapped in this paper was 5.9 to 6.3cmWG at a flow rate of 1050cm$^3$min$^{-1}$.

The cigarette, when smoked under the standard conditions, delivered 28.0 mg TPM, 1.68 mg nicotine and 9.6 mg carbon monoxide. The ratio of CO to nicotine was 5.7. The cigarette gave 13 puffs.

EXAMPLE 3

The same conventional cigarette wrapping paper was perforated mechanically to give a porosity of 5,600cm$^3$min$^{-1}$10cm$^{-2}$10cmWG$^{-1}$. The mean number of holes per cm$^2$ paper was 50 and their mean diameter 120$\mu$. The strength of the perforated paper was 95 g per mm width. The pressure drop of the tobacco rod, similar to that of Example 1, wrapped in this paper was 4.9 to 5.3cmWG at a flow rate of 1050cm$^3$min$^{-1}$. The cigarette when smoked under the standard conditions, delivered 20.7 mg TPM, 1.33 mg nicotine and 5.4 mg carbon monoxide, the ratio of CO to nicotine being 4.1. The puff number was 13.5.

EXAMPLE 4

A cigarette made from a blend of flue-cured Virginia tobacco consisted of a tobacco rod 45 mm long with a circumference of 25.0 mm, to which was attached a conventional cellulose acetate filter of 25 mm length having a filtration efficiency for nicotine of 22%. As in Example 1, the conventional wrapping paper was electrostatically perforated to give a porosity of 8500. The mean number of holes per cm$^2$ paper was 80 and their mean diameter 110$\mu$. The strength of the perforated paper was 95 g per mm width. The pressure drop of the tobacco rod wrapped in this paper was 2.5 to 2.9cmWG. The filter cigarette, when smoked under the standard conditions, delivered 11.6 mg TPM, 0.90 mg nicotine and 3.9 mg carbon monoxide. The ratio of CO to nicotine was 4.3 and the puff number 8.

An otherwise identical filter cigarette wrapped in non-perforated paper produced 6 to 7 puffs and delivered 23.6 mg TPM, 1.47 mg nicotine and 16.3 mg carbon monoxide, the ratio of CO to nicotine being 11.1. The use of the perforated paper thus achieved a considerable reduction in carbon monoxide also in the case of a filter cigarette.

EXAMPLE 5

A cigarette was made from a blend of flue-cured, air-cured and oriental tobaccos. The cigarette consisted of a tobacco rod 70 mm long with a circumference of 25.0 mm. A conventional cigarette wrapping paper similar to that used in Example 1 was electrostatically perforated to give a porosity of 8500, the mean number of holes being 80 with a mean diameter of 110$\mu$. The tensile strength of the perforated paper was 95 g per mm width. The pressure drop of the tobacco rod wrapped in this paper was 2.8 to 3.0cmWG.

On smoking under the standard conditions, the cigarette delivered 16.5 mg TPM, 1.05 mg nicotine and 4.1 mg carbon monoxide, the ratio of CO to nicotine being 3.9. The puff number was 14. A cigarette made from the same tobacco wrapped in conventional non-perforated paper delivered 45.6 mg TPM, 2.75 mg nicotine and 18.9 mg CO, the ratio of CO to nicotine being 6.9. The puff number was 11.5.

EXAMPLE 6

A filter cigarette was produced as for example 4, but using a tobacco blend as in Example 5. The wrapping paper was electrostatically perforated to give a porosity of 8500. The paper had a tensile strength of 95 g per mm width. The mean number of holes was 80 and the mean diameter 110$\mu$. The pressure drop of the tobacco rod wrapped in this paper was 2.0 to 2.2cmWG and the filter had a filtration efficiency for nicotine of 22%.

The filter cigarette, when smoked under the standard conditions, delivered 13.3 mg TPM, 1.04 mg nicotine and 6.0 mg carbon monoxide, the ratio of CO to nicotine being 5.8. The puff number was 7.5. A similar filter cigarette, but wrapped in non-perforated paper delivered 26.5 mg TPM, 1.57 mg nicotine and 13.9 mg carbon monoxide, the ratio of CO to nicotine being 8.9. The puff number was 6.

EXAMPLE 7

A filter cigarette was prepared as for Example 6 from a tobacco blend as in Example 5, but the wrapping paper was mechanically perforated to give a porosity of 5600. The tensile strength of the perforated paper was 95 g per mm width. The mean number of holes was 50 and their mean diameter 120$\mu$. The tobacco rod had a pressure drop of 2.4 to 2.6cmWG and the filter had a filtration efficiency for nicotine of 22%. The filter cigarette, when smoked under the standard conditions, delivered 21.5 mg TPM, 1.36 mg nicotine and 7.1 mg carbon monoxide. The ratio of CO to nicotine was 5.2 and the puff number 7. The deliveries of a similar filter cigarette wrapped in conventional non-perforated paper were as given in Example 6.

We claim:

1. A cigarette comprising;

a rod of tobacco wrapped in a material consisting of a very highly porous paper, with an air porosity within the range from 2,450 to 20,000cm$^3$min$^{-1}$10cm$^{-2}$10cmWG$^{-1}$ produced from a base paper having a tensile breaking strength of not less than 85 g per mm width of paper by perforation of the paper wherein upon combustion the effect of said material is to produce a low ratio of carbon monoxide to nicotine content in the smoke stream.

2. A cigarette according to claim 1, wherein the mean number of perforations is within the range from 10 to 150 per cm$^2$ of the paper and the mean diameter thereof is within the range from 30 to 200 microns.

3. A cigarette according to claim 1, wherein the wrapping material, in the form of a strip, has a non-perforated margin at each longitudinal edge.

4. A cigarette according to claim 1, provided with a tobacco-smoke filter having a filtration efficiency for nicotine within the range of 15 to 30%.

* * * * *